US006039852A

United States Patent [19]

Federico

[11] Patent Number: 6,039,852

[45] Date of Patent: Mar. 21, 2000

[54] BIPOLAR PLATE FOR FILTER PRESS ELECTROLYZERS

[75] Inventor: Fulvio Federico, Piacenza, Italy

[73] Assignee: DE NORA S.p.A., Italy

[21] Appl. No.: 09/180,056

[22] PCT Filed: May 6, 1997

[86] PCT No.: PCT/EP97/02288

§ 371 Date: Oct. 27, 1998

§ 102(e) Date: Oct. 27, 1998

[87] PCT Pub. No.: WO97/42359

PCT Pub. Date: Nov. 13, 1997

[30] Foreign Application Priority Data

May 6, 1996 [IT] Italy ..... MI96A0911

[51] Int. Cl.[7] ..... C25B 9/00

[52] U.S. Cl. ..... 204/255; 204/268; 204/280; 204/294

[58] Field of Search ..... 204/255, 268, 204/294, 280

[56] References Cited

U.S. PATENT DOCUMENTS

| | | | |
|---|---|---|---|
| 4,339,322 | 7/1982 | Balko et al. | 204/255 |
| 4,346,150 | 8/1982 | Bellows et al. | 428/18 |
| 4,554,063 | 11/1985 | Braun et al. | 204/268 |
| 4,758,322 | 7/1988 | Sioli | 204/268 |
| 5,296,121 | 3/1994 | Beaver et al. | 204/268 |
| 5,322,597 | 6/1994 | Childs et al. | 204/268 |
| 5,756,874 | 5/1998 | Steward | 204/268 |

FOREIGN PATENT DOCUMENTS 645674 10/1984 Switzerland .

*Primary Examiner*—Bruce F. Bell
*Attorney, Agent, or Firm*—Bierman, Muserlian and Lucas

[57] ABSTRACT

Bipolar plate made of a composite material for use in a filter-press electrolyzer. Said plate comprises a central portion (6) which is electrically conductive and is obtained by heat-pressing of a mixture of graphite or conductive carbon and a thermoplastic polymer powder resistance to corrosion and two terminal portions (7,8) containing the distribution holes (2,3,4,5) for the inlet of the fresh electrolytes and for the outlet of the exhausted electrolytes and electrolysis products. Said terminal portions are integral with the central portion and are obtained during said heat-pressing from a mixture of graphite or conductive carbon and said thermoplastic polymer powder with a ratio between said powders lower than that of the central portion. Said mixture of the terminal portions may further contain also a non-conductive compound powder, in which case the mixture may also be free from graphite or conductive carbon powder.

5 Claims, 1 Drawing Sheet

BIPOLAR PLATE FOR FILTER PRESS ELECTROLYZERS

BACKGROUND OF THE INVENTION

Membrane electrolysis processes of industrial interest such as chlorine and caustic soda production from sodium chloride solutions and even more for the production of chlorine from hydrochloric acid solutions or directly from gaseous hydrochloric acid as described in U.S. Pat. No. 5,411,641, J. A. Trainham III, C. G. Law Jr, J. S. Newman, K. B. Keating, D. J. Eames, E. I. Du Pont de Nemours and Co. (USA), May 2, 1995, undergo extremely aggressive conditions.

In the process for the production of caustic soda and chlorine, the anodic reaction produces chlorine gas which, as is well known, is a strongly corrosive agent. For this reason, in industrial practice usually titanium is used for the anodic elements of the elementary cells forming the electrolyzers. The use of titanium, in this case, is permitted by the relatively modest acidity of the sodium chloride brine in contact with said anodic parts. The acidity is kept at low levels for process reasons and mainly not to damage the delicate ion-exchange membranes separating with a high efficiency the produced caustic soda from the acid brine Suppliers of this kind of membranes specify in fact that the minimum pH for continuous operation must be kept around 2.

Titanium cannot be used for the construction of the cathodic parts of the elementary cells forming the electrolyzer, as the hydrogen evolution, which is the only cathodic reaction, would cause a dramatic embrittlement. In most cases the cathodic parts of the elementary cells are made of high-alloy stainless steels or even better nickel. As a consequence, in bipolar electrolyzers, the bipolar elements which coupled together in a filter-press arrangement form the elementary cells, are made of two layers made of nickel and titanium connected either mechanically (U.S. Pat. No. 4,664,770, H. Schmitt, H. Schurig, D. Bergner, K. Hannesen, Uhde GmbH, May 12, 1987) or by welding (U.S. Pat. No. 4,488,946, G. J. E. Morris, R. N. Beaver, S. Grosshandler, H. D. Dang, J. R. Pimlott, The Dow Chemical Co., Dec. 18, 1984), optionally with an internal layer directed to ensure the electrical conductivity and necessary rigidity. These bipolar elements obviously entail a complicated construction and therefore high costs.

In the production of chlorine by electrolysis of hydrochloric acid, the aggressivity is much greater due to the concurrent presence of chlorine and high acidity. Under particular conditions (temperature below 60° C., acid concentration below 20%, addition of passivating agents) a titanium—0.2% palladium alloy (ASTM B265, Grade 7) may be used with the interstice areas suitably protected by a proper ceramic coating. With temperatures and acid concentrations higher than the above mentioned ones and in the absence of passivating agents, the only suitable material for the construction of the anodic parts of the electrolyzer is tantalum, an extremely expensive material which poses a lot of problems for its working.

Anyway, tantalum, just as titanium, is not compatible with hydrogen and therefore cannot be used for the cathodic parts. A possible solution is given by the nickel alloys of Hastelloy B® type, but they are very expensive and undergo corrosion during the shut-downs of the electrolyzers. To avoid this severe inconvenience, it would be necessary providing the electrolysis plants with polarization systems, which would make scarcely practical the whole construction.

A possible alternative is offered by graphite, which is sufficiently stable at the process conditions, both the anodic (chlorine evolution with minor quantities of oxygen, in the presence of chlorides and acidity), and the cathodic ones (hydrogen in the presence of caustic soda—chlor-alkali electrolysis—or in the presence of acidity electrolysis of hydrochloric acid). Therefore graphite may be used in the form of plates directly forming the elements which are then assembled in a filter press-arrangement to form the elementary cells of electrolyzers. In the case of bipolar electrolyzers the two faces of the same graphite plate actually act as the cathodic wall of one cell and the anodic wall of the adjacent cell. As graphite is intrinsically porous, the mixing of chlorine and hydrogen, caused by diffusion through the pores, may be avoided only making the graphite plates impermeable by means of processes comprising filling under vacuum of the pores with a liquid resin which is subsequently polymerized and makes the graphite plate more stiff and enhances its chemical resistance characteristics. Graphite plates of this type are currently used in the industrial process known as "Uhde-Bayer" process for the electrolysis of hydrochloric acid solutions. Impermeable graphite however is extremely fragile and is not deemed acceptable for most chlorine producers, especially in critical apparatuses such as electrolyzers for chlorine production.

An interesting alternative is disclosed by U.S. Pat. No. 4,214,969, R. J. Lawrance, General Electric Company, Jul. 29, 1980 directed to the production of plates made of graphite powder and thermoplastic fluorinated polymers. The product obtained by heating and pressing the powders mixture is a composite having a minimum or no porosity, exhibiting a suitable electrical conductivity. This last characteristic is obviously necessary as the plates must provide for an efficient electric current transmission to ensure a correct operation of the electrolyzers. The advantage of the graphite-polymer composite over impermeable graphite is its higher stiffness. In fact, the two requisites, stiffness and electrical conductivity, are contradictory as a higher stiffness involves a greater amount of polymer while a greater amount of graphite would be necessary to enhance the electrical conductivity. As a consequence, an optimized product must be a compromise between the two needs, a compromise which the above patent indicates to be a function of the production parameters, in particular pressure and temperature.

When the thermoplastic fluoropolymer is the polyvinylidenefluoride, such as Kynar® produced by da Pennwalt (USA), the best results in terms of electrical conductivity and stiffness (measured as resistance to bending) are obtained with contents of polymer in the range of 20–25% by weight. Obviously, a composite plate obtained as above illustrated and with the aforesaid material is intrinsically expensive.

A reduction of the total costs of an electrolyzer obtained by assembling in a filter press-arrangement several plates may be achieved by eliminating from each plate every external connection (threaded joints, pipes, gaskets) for the circulation of the electrolytes and withdrawals of the products. This simplified design certainly increases the operation reliability of the electrolyzers, in particular when operating under pressure. The elimination of the external connection requires that each plate be provided with suitable internal holes provided with suitable distribution systems, as described in details in U.S. Pat. No. 4,214,969. the multiplicity of plates of the filter-press electrolyzer must have all the holes matching in order to form longitudinal channels inside the electrolyzer structure. These channels (manifolds), which are connected to suitable nozzles positioned on one or both sides of the electrolyzer heads, provide for the internal distribution to the various elementary cells of the fresh electrolytes and for the withdrawal of the exhausted electrolytes and electrolysis products (for example chlorine and oxygen). Said channels longitudinally crossing the electrolyzer are therefore subjected to a remarkable electric potential gradient. Further, if both the fresh and the exhausted electrolytes have a sufficient electrical conductivity (hydrochloric acid, sodium chloride brine and caustic soda are highly conductive), then the channels are crossed by consistent electric current, the so-called shunt current, which represent an efficiency loss and cause electrolysis phenomena among the surfaces of the plates facing the channels.

These electrolysis phenomena produce substantially two negative effects, that is the reduced purity of the electrolysis products and the corrosion of at least part of the composite plate surfaces. As a matter of fact also the graphite particles forming the composite may undergo corrosion and be progressively worn out and converted into carbon monoxide and/or carbon hydroxide under the electrolysis conditions typical of said channels. As a consequence, the composite looses its major components and thus any mechanical solidity.

U.S. Pat. No. 4,371,433, E. N. Balko, L. C. Moulthrop, General Electric Company, Feb. 1, 1983, describes a method for reducing parasitic shunt currents and eliminating corrosion phenomena. This method foresees a particular profile of the manifolds in order to cause a fractionating of the electrolyte flow in small droplets (increase of the overall electrical resistance) housing particular gaskets inside the manifolds. Substantially the surface of the composite plates facing the manifold is internally lined with the gaskets and cannot get in contact with the electrolytes. However, in view of the fact that these gaskets have a complex geometry and are made of elastomeric fluorocarbon materials which must ensure a high chemical resistance, such as Viton® polyhexafluoropropylene rubber supplied by DuPont (USA), this method is very expensive and therefore scarcely applicable in industrial practice.

SUMMARY OF THE INVENTION

It is the aim of the present invention to overcome the problems of the prior art by providing for a method for protecting the composite graphite (or conductive carbon)—thermoplastic (preferably, but not exclusively, fluorinated) polymer in those areas where the surface of said plates faces the longitudinal manifolds. The method of the invention has the advantage of not increasing noticeably the production cost of a common composite plate and may be realized in the production of said plate.

The present invention solves the problem of localized corrosion in those areas where the surface of said plates faces the longitudinal manifolds by suitably decreasing, or even eliminating, the content of graphite powder or conductive carbon powder in the terminal portions of said bipolar plates. Said terminal portion contain the holes which, after assembling in a filter-press arrangement of the bipolar plates, form the longitudinal channels (manifolds).

DESCRIPTION OF THE PREFERRED EMBODIMENT

Figure 1:
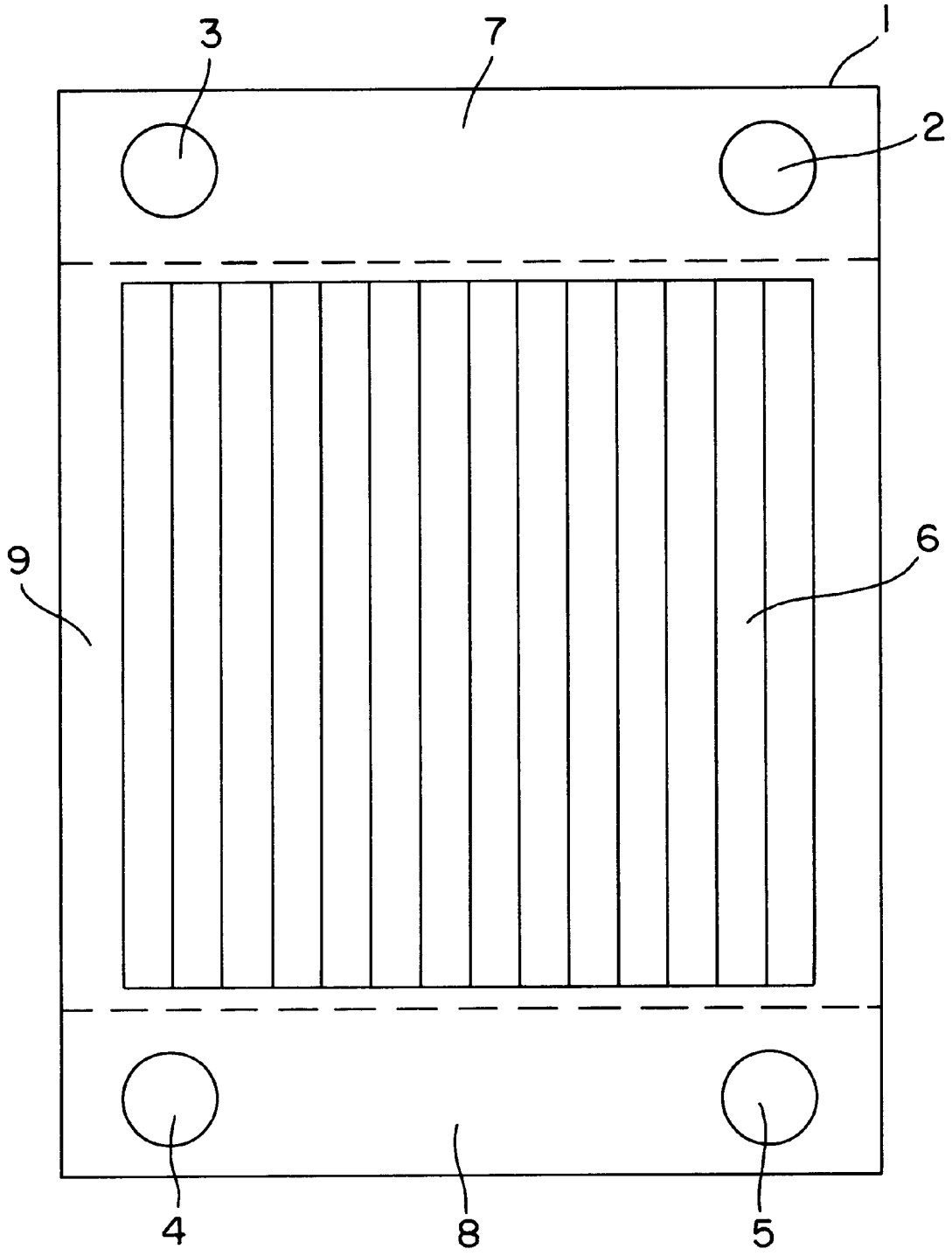
FIG. 1 is a frontal view of the bipolar plate of the invention.

The present preferred embodiment of the invention will be now described making reference to FIG. 1 which is a frontal view of the bipolar plate.

With ref. to FIG. 1, the bipolar plate 1 is provided with holes 2, 3, 4, and 5 which, after assembling in a filter-press arrangement of adjacent bipolar plate, form the longitudinal channels (manifolds) and with longitudinal grooves 6 directed to favour the circulation and distribution of electrolytes. Said grooves 6 may be also avoided and the bipolar plate may alternatively have a flat surface.

The terminal portions 7 and 8 of the bipolar plate have a reduced content of graphite powder or may even not contain graphite at all. The central portion 9 of the bipolar plate has a greater are with respect to terminal portion 7 and 8 and is made of a composite with a high content of graphite and thus highly conductive and said terminal portions 7 and 8 are at least ten times higher than that of the central portion 9. Said central portion 9 is in fact directed to transmit electric current to the electrodes (anodes and cathodes) which are in contact with said central portion and substantially have the same area.

By decreasing or even eliminating the content of graphite or conductive carbon in the conductive area 7 and 8, corrosion problems are avoided. These corrosion problems are due to the fact that the surfaces of the bipolar plate facing the longitudinal channels (manifolds) (circumferential surfaces of the holes 2, 3, 4 and 5 in FIG. 1) may act as electrodes and in particular as alternated anodes and cathodes due to the effect of the electric potential gradient across the electrolyzer. On the surfaces acting as cathodes hydrogen is evolved and no problem of stability in the graphite or conductive carbon polymer is experienced. On the surfaces acting as anodes the chloride ions discharged to form chlorine. This reaction is characterized by high efficiency but not 100%, and involves a parasitic reaction of water discharge with oxygen evolution. Under these conditions the graphite or conductive carbon particles are slowly attached and are converted into carbon monoxide and/or carbon hydroxide. When the composite is conductive, the graphite particles are so concentrated that it may be assumed that statistically said particles get in contact with each other forming conductive chains throughout all the plates thickness. Therefore when corrosion causes the complete depletion of the plate the attach does not stop but continues in the adjacent plate, giving rise to a porosity crossing the composite bulk which consequently looses any mechanical stiffness.

The most obvious solution would seem the complete elimination of the graphite powder manufacturing the terminal portions 7 and 8 of the bipolar plate 1 with the thermoplastic polymer powder only. As already said, this is an extreme solution which may involve mechanical problems. In fact in this case the composite plate would be made, as aforementioned, by compression and heating of a mixture of graphite and thermoplastic polymer powder (optionally in the form of pre-formed pellets) spread on the central portion of the mold, and powder or pellets of the polymer only spread in the area of the mold corresponding to the terminal portions 7 and 8 of the bipolar plate. When a similar plate with portions having different content of graphite powder cools down, severe distortions are frequently experienced, caused by the different thermal expansion coefficients of the portions having a different content of graphite. In particular, the terminal portions made of thermoplastic polymer only are characterized by a much greater thermal expansion coefficient. To avoid distortion problems hindering the production of perfectly planar plates, the graphite content must be reduced but not eliminated. To define the exact content of graphite powder necessary to avoid the above problems, the electrical resistively values of various composites have been measured and are listed in Table 1.

TABLE 1

Electrical resistivity of various composites comprising polyvinlyidene fluoride and graphite powder (Stackpole A-905)

| Graphite percentage | Resistivity (milliohm/cm) |
|---|---|
| 93 | 5.0 |
| 86 | 5.2 |
| 80 | 6.6 |
| 75 | 9.2 |
| 60 | 75.0 |
| 40 | 201.2 |

Similar results are obtained by substituting at least partially the graphite powder with graphite fibers are disclosed by U.S. Pat. No. 4,339,322, E. N. Balko, R. J. Lawrance, General Electric Company, Jul. 13, 1982. The production cycle comprises cold-compression at 145 bar, heating at 150° C., decreasing the pressure to 20 bar, increasing the temperature to 205° C., bringing back the pressure to 145 bar, with a final phase of step-by-step reduction of pressure and temperature. Table 1 clearly indicates that a substantial reduction of the graphite powder content to 40% still leaves a minimum electrical conductivity which means that the graphite particles (or their aggregates) at least partially form electrical continuity bridges. Corrosion tests have been carried out under current, that is using samples of composites containing 40% by weight of graphite powder working as anodes in sodium chloride brine and hydrochloric acid. It resulted that corrosions affects only small areas, the ones where the infrequent conductivity bridges exits, (chains of graphite particles in contact with each other). As a consequence, the porosity of the composite is modest and the mechanical characteristics are not affected.

It has been found that a complete immunity to the porosity caused by corrosion may be obtained by further decreasing the content of graphite powder, for example down to 20% by weight or even below. However, in this case distortion phenomena are again present, typical of bipolar plates with terminal portions 7 and 8 made of thermoplastic polymer only, in particular when it is polyvinylidenefluoride characterized by a particularly high thermal expansion coefficient. In fact, the thermal expansion coefficient of the composite containing 20% by weight of graphite is much higher than that of a composite having a high content of graphite (e.g. 80% by weight) used for central portion 9 of bipolar plate 1.

It has been found that the above problem may be overcome if the terminal portions 7 and 8 of the bipolar plate are produced with a mixture comprising powders of graphite, in minor amounts (20% by weight or less), of a thermoplastic polymer and of a non-conductive corrosion resistant filling material.

The best results are obtained when the percentage of thermoplastic polymer calculated on the total weight of the ternary mixture are the same as those of the central portion 9 of the bipolar plate 1.

It has been further found that the filling material must be carefully selected taking into consideration the chemical characteristics of the thermoplastic polymer. In fact when the latter is a fluorinated polymer (best preferred due to it high chemical inertness), a chemical reaction between the polymer and the filling material may take place at the temperatures reached during molding of the bipolar plate. For example when the thermoplastic polymer is polyvinylidenefluoride, it may violently react with silica powder or boro oxide and possibly form volatile compounds such as silica tetrafluoride or boro trifluoride. Further, the additional filling material must be stable in contact with the acidic sodium chloride brines and the hydrochloric acid solutions containing chlorine. It has been found that certain ceramic oxides, such as niobium pentoxide, tantalum pentoxide, zirconium oxide, lanthanum oxide, thorium oxide, rare earths ceramic oxides, and some silicates are suitable for use. Also suitable for use are certain insoluble salts, such as for example barium sulphate.

Even if barium sulphate is quite satisfactory for the destination of the bipolar plate of the invention, it has been found that the best mechanical characteristics, particularly resistance to bending, are obtained by using the various oxides or silicates as listed above. It may be assumed that this additional positive effect be due to a minimum chemical reaction between the particles surface and the fluorinated polymer. This reaction, which is quite tolerable, may cause an improved adhesion at the polymer-particle interface.

By suitably selecting the quantities of powder of the above mentioned composite, the graphite powder content may be also eliminated from the powder mixture used for producing the terminal portions 7 and 8 of the bipolar plate. The optimum ratios by weight depend on the characteristics of the material and on the density of the particles which is a function of the chemical composition, of the crystal structure and porosity. The experimental data relating to the optimum ratio among the various filling materials seem to indicate that the most important parameter is the volumetric ration between the filling material and the total mixture.

This is the main object of the present invention. It is obvious that further embodiments could be devised which are not specifically defined in the present disclosure, however, it is understood that the present invention is not intended to be limited thereto.

EXAMPLE 1

Sixteen strips having dimension 1×1×10 cm have been cut from 4 sheets (4 strips for each sheet) 1 cm thick having dimensions 10×10 cm, obtained with the powder listed in Table 2. The thermoplastic polymer was polyvinylidenefluoride supplied by Atochem. The production cycle comprised cold-compression of the powder mixture in a mold at 145 bar, heating at 150° C., decreasing the pressure to 20 bar, increasing the temperature to 205° C., bringing back the pressure to 145 bar, with a final phase of step-by-step reduction of pressure and temperature.

After cooling the four sheets appeared planar. Each pair of strips has been subjected to a 3 Volt energy output after introducing the two pairs of strip in two containers with 5% hydrochloric acid and 200 g/l, pH 3 sodium chloride. Both solutions were continuously renewed in order to keep the concentrations in a variation range of 10%. Temperature was maintained at 90°C. In this way each composition was tested both under anodic and cathodic polarization. The strips under cathodic polarization were immune from any attack. The data reported in Table 2 show the behaviors of the various samples under anodic polarization. The strips cut from the sheet with a high content of graphite (Stackpole A-905, 80% by weight, typical of the prior art) show a remarkable drop of the mechanical characteristics after only 2 days of electrolysis in the sodium chloride solutions and after 5 days of electrolysis in the hydrochloric acid solution.

A definitely better behavior was shown by the strips obtained from the sheet having a low content of graphite (40% by weight), however these strips are negatively affected by increased roughness indicating that some porosity, even if small, occurred.

The strips containing a small amount of graphite (20% by weight) and an additional quantity of tantalum pentoxide or barium oxide were immune from any attack. A similar result was obtained with samples containing tantalum pentoxide, niobium pentoxide, barium oxide. The relevant data are not included in Table 2.

TABLE 2

Behavior of various composites under anodic polarization in sodium chloride solutions (220 grams per liter) and hydrochloric acid (5%).

| Sample (% of powder) | Sodium chloride | Hydrochloric acid |
|---|---|---|
| graphite 80% | high porosity after 2 days | high porosity after 5 days |
| graphite 40% | increased roughness after 10 days | increased roughness after 10 days |
| graphite 20% + tantalum pentoxide 65% | no variation after 10 days | no variation after 10 days |
| graphite 20% + barium sulphate 68% | no variation after 10 days | no variation after 10 days |

I claim:

1. Bipolar plate for use in bipolar electrolyzer of the filter-press type, said plate (1) comprising a central portion (9) made of a conductive composite obtained from a mixture of graphite or conductive carbon powder or fibers and powder of a corrosion resistant thermoplastic polymer, and two terminal portions (7,8) made of a composite obtained from a mixture of said graphite or conductive carbon powder or fibers and said powder of the corrosion resistant thermoplastic polymer, said terminal portions having a higher electrical resistively than the central portion and containing holes (2,3,4,5) for distribution of fresh electrolytes and the withdrawal of exhausted electrolytes and electrolysis products, said central portion (9) and terminal portions (7,8) forming an integral element, characterized in that said central portion (9) contains more than 60% by weight of said graphite or conductive carbon powder or fibers, said terminal portions (7,8) have a low content of said graphite or conductive carbon powder or fibers such that the electrical resistively of said terminal portions (7,8) is at least ten times higher than that of the central portion (9), and said terminal portions (7,8) further comprise an additional non-conductive corrosion resistant material to reduce the difference in the thermal expansion coefficient between said central portion (9) and said terminal portions (7,8).

2. The bipolar plate of claim 1 characterized in that said additional non-conductive material is selected from the group consisting of tantalum pentoxide, niobium pentoxide, zirconium oxide, and barium sulphate.

3. The bipolar plate of claim 1 characterized in that said composite of the terminal portion is obtained from a mixture not containing graphite or conductive carbon.

4. The bipolar plate of claim 1 characterized in that said thermoplastic polymer is a fluorinated polymer.

5. The bipolar plate of claim 4 characterized in that said thermoplastic polymer is polyvinylidenefluoride.

* * * * *